US005413223A

United States Patent [19]

Kang

[11] Patent Number: 5,413,223

[45] Date of Patent: May 9, 1995

[54] HOLDER FOR EMERGENCY FLASHLIGHT

[76] Inventor: Woo J. Kang, 170-145, Younhee-Doug, Seoudaemoon-ku, Rep. of Korea

[21] Appl. No.: 210,345

[22] Filed: Mar. 18, 1994

[51] Int. Cl.[6] ..... B65D 69/00; F21L 7/00

[52] U.S. Cl. ..... 206/573; 206/349; 206/446; 211/26; 211/70.6; 211/89; 362/190; 362/207

[58] Field of Search ..... 206/349, 446, 573, 803; 211/60.1, 70.6, 89, 26; 362/190, 191, 207, 194, 202, 205

[56] References Cited

U.S. PATENT DOCUMENTS

| | | | |
|---|---|---|---|
| 1,316,870 | 9/1919 | Wacker | 206/349 X |
| 3,265,880 | 8/1966 | Whitman | 362/207 |
| 3,300,264 | 1/1967 | Daniels et al. | 206/333 X |
| 3,333,095 | 7/1967 | Moess | 362/207 X |
| 4,750,095 | 6/1988 | Huang | 362/190 |
| 5,008,785 | 4/1991 | Maglica et al. | 362/190 X |
| 5,048,677 | 9/1991 | Pedracine | 206/349 X |
| 5,188,450 | 2/1993 | Anderson | 362/194 |

FOREIGN PATENT DOCUMENTS

| | | | |
|---|---|---|---|
| 2172097 | 9/1986 | United Kingdom | 362/194 |

*Primary Examiner*—Bryon P. Gehman
*Attorney, Agent, or Firm*—Roger A. Marrs

[57] ABSTRACT

A holder for an emergency flashlight having a construction capable of holding reserve batteries and a reserve miniature bulb. The emergency flashlight holder includes an extension extending from a holder body holding an emergency flashlight therein, an inner rim provided at the extension, the inner rim having a pair of hinges respectively protruded from opposite portions of one end thereof and a pair of locking notches respectively formed at opposite portions of the other end thereof, a bulb holding member protruded from an inner surface of the extension, a lid hingewise coupled to the extension such that it moves between an opened position and a closed position, the lid having a pair of hinge holes respectively engaged with the hinges and a pair of locking lugs respectively protruded from inner surfaces of opposite side walls of the lid and engaged in the locking notches at the closed position of the lid, and at least one reinforcing member protruded from an inner upper surface of the lid, the reinforcing member having a battery supporting groove.

2 Claims, 2 Drawing Sheets

HOLDER FOR EMERGENCY FLASHLIGHT

BACKGROUND OF THE INVENTION

1. Field of the Invention

The present invention relates to a holder for an emergency flashlight usable in interruption of electric power without warning or other emergency situations encountered at night in the home and the office.

2Description of the Prior Art

As well-known, emergency flashlights are useful in interruption of electric power without warning or other emergency situations encountered at night in the home and the office. For a prompt use, such emergency flashlights are mostly held on walls of rooms or living rooms. Since an emergency flashlight can not be held by itself on a desired area, it is required to use an emergency flashlight holder. The emergency flashlight holder is fixedly installed on a desired wall area and, then, an emergency flashlight is fitted in the installed holder, so that an emergency flashlight can be safely kept.

Generally, such an emergency flashlight associated with the holder is constructed to be automatically turned on when it is separated from the holder and automatically turned off when it is fitted in the holder without any manipulation. For such a function, the emergency flashlight has a hole formed at a portion of an flashlight outer casing corresponding to a connection or contact between two batteries contained in the emergency flashlight and connected in series. Also the holder has a battery spacer associated with the hole of the emergency flashlight. When the emergency flashlight is fitted in the holder, the battery spacer is inserted into the hole of the emergency flashlight and then between the batteries contained in the emergency flashlight, thereby causing the batteries to be disconnected. As a result, the emergency flashlight is held in the holder while being kept at its turned-off state.

However, such a conventional emergency flashlight holder has various disadvantages.

In many cases, the emergency flashlight is left for long time as being held in the holder because of its function unexpectedly used only in an emergency situation. For this reason, it can not be ensured, unless periodical checks are made, that the performance and the operation of the emergency flashlight are well. In actual, the emergency flashlight may give a poor light because the batteries contained in the emergency flashlight has already been degraded in performance prior to a separation of the emergency flashlight from the holder for its use in an emergency situation. Where the bulb of the emergency flashlight has already been burnt out, the emergency flashlight is useless. Furthermore, it is unusual that reserve batteries and reserve bulbs are kept in the home. In this case, the flashlight has its function as an emergency flashlight no longer. Even if reserve batteries and reserve bulbs are present, they may be useless unless kept at a place where a user has an easy access thereto in an emergency situation.

SUMMARY OF THE INVENTION

Therefore, an object of the invention is to eliminate the above-mentioned disadvantages encountered in the prior art and, thus, to provide a holder for an emergency flashlight having a construction capable of holding reserve batteries and a reserve miniature bulb.

In accordance with the present invention, this object can be accomplished by providing a holder for an emergency flashlight comprising a holder body having a pair of end members defining flashlight holding grooves for holding said emergency flashlight therein, a light grip opening defined between said end members, and a battery spacer protruded from said holder body with a space or opening to grip said flashlight, said holder further comprising: an extension extending from one of said end members; an inner rim provided at said extension, said inner rim having a pair of hinges respectively protruded from opposite portions of one end thereof and a pair of locking notches respectively formed the other end thereof; a bulb holding member protruded from an inner surface of the extension; a lid hinged to the extension such that it moves between an opened position and a closed position, said lid includes a sidewall having a pair of hinge holes respectively engaged with said hinges and a pair of locking lugs respectively protruded from opposite inner surfaces of side walls of the lid and engaged in said locking notches at the closed position of the lid; and at least one reinforcing member protruded from an inner upper surface of the lid, said reinforcing member having a battery supporting groove.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENT

Figure 1:
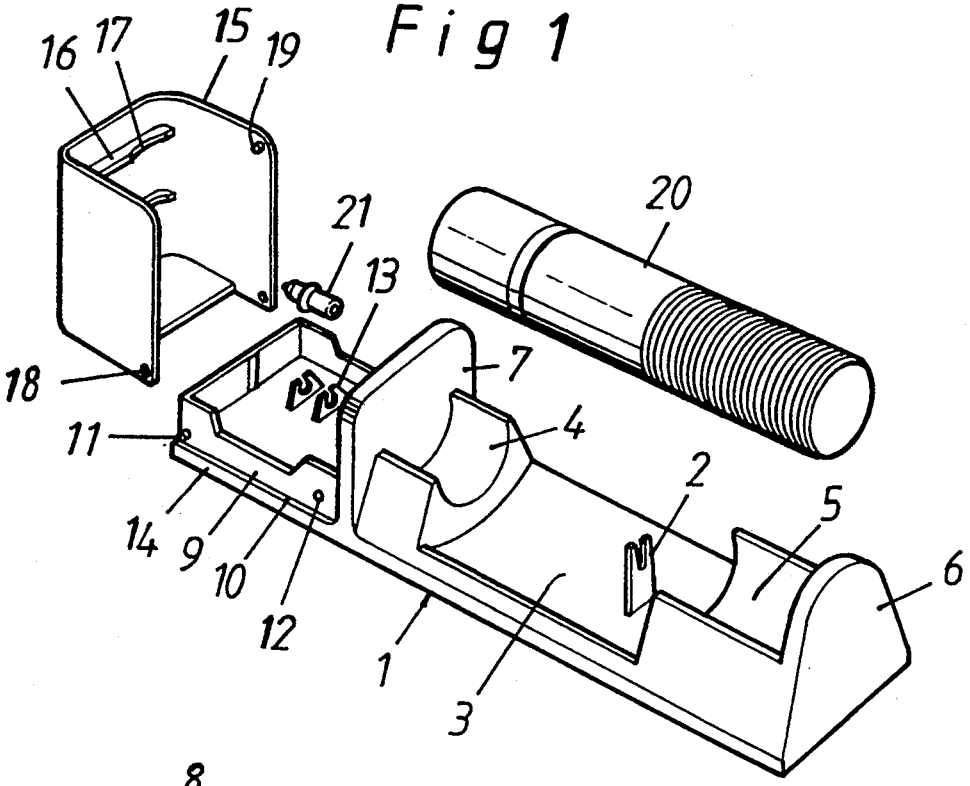
FIG. 1 is an exploded perspective view of a holder for an emergency flashlight in accordance with the present invention.
Figure 2:
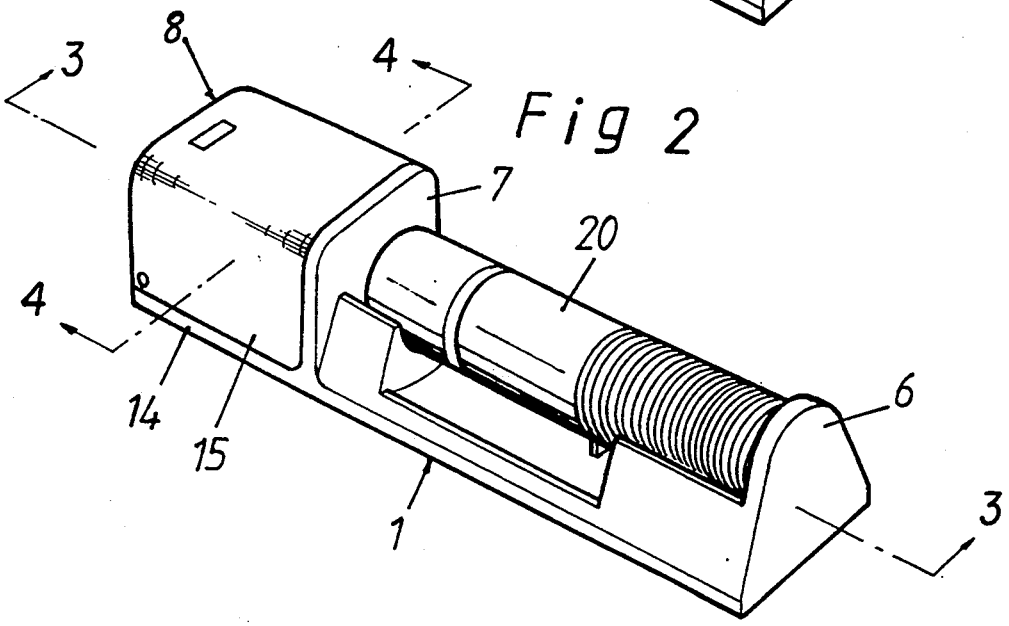
FIG. 2 is an assembled perspective view of the emergency flashlight holder shown in FIG. 1.

Referring to FIGS. 1 and 2, there is shown a holder for an emergency flashlight in accordance with the present invention.

As best shown in FIG. 1, the emergency flashlight holder comprises a holder body 1 having a pair of end members 6 and 7 respectively formed at opposite ends of the holder body 1. The end members 6 and 7 have flashlight holding grooves 4 and 5, respectively. A flashlight grip opening 3 is defined between the end members 6 and 7. A battery spacer 2 is protruded from the holder body 1 in the flashlight grip opening 3. These constructions are similar to those of conventional emergency flashlight holders.

In accordance with the present invention, the emergency flashlight holder includes an extension 14 extending from the end member 7. The extension 4 has an inner rim 9 and a peripheral step 10 formed between the inner rim 9 and the peripheral edge of the extension 14.

A pair of hinges 11 are protruded from opposite sides of one end of the inner rim 9 positioned away from the end member 7, respectively. The inner rim 9 also has a pair of locking notches 12 formed at opposite sides of the other end of inner rim 9 positioned adjacent to the end member 7. A bulb holding member 13 is protruded from the inner surface of extension 14.

To the extension 14, a lid 15 is hinged. The lid 15 has a pair of hinge holes 18 which are engaged with the hinges 11 provided at the inner rim 9, respectively. At least one reinforcing member 16 is integrally formed with the lid 15 such that it is protruded from the inner upper surface of the lid 15. In the illustrated case, two reinforcing members 16 are provided. Each reinforcing member 16 has a battery supporting groove 17. A pair of locking lugs 19 are protruded from respective inner surfaces of the inner opposite side walls of the lid 15. The locking lugs 19 are engaged in the notches 12 of extension 14 when the lid 15 is closed.

Now, use of the emergency flashlight holder having the above-mentioned construction in accordance with the present invention will be described.

Figure 3:
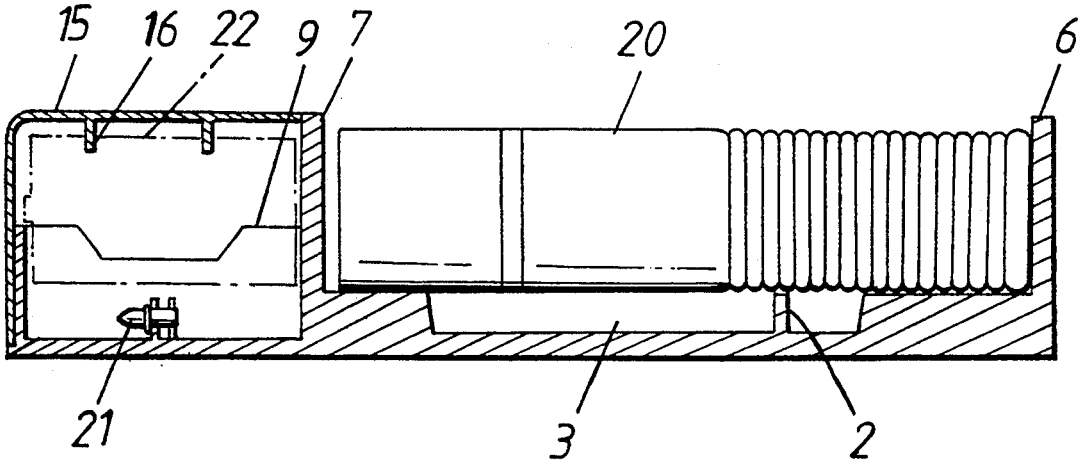
FIG. 3 is a cross-sectional view taken along the line A—A of FIG. 2.
Figure 4:
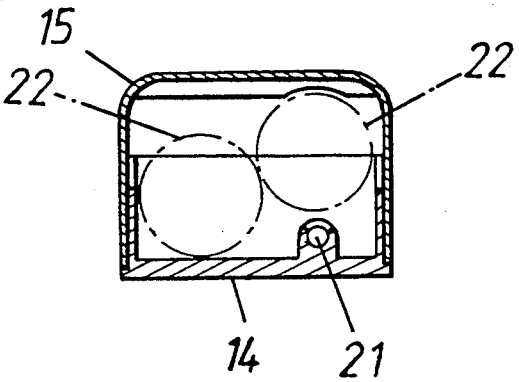
FIG. 4 is a cross-sectional view taken along the line B—B of FIG. 2.

As shown in FIGS. 3 and 4, a reserve miniature bulb 21 is fitted in the bulb holding member 13 provided at the extension 14 in a space defined by the inner rim 9. Also two reserve batteries 22 are contained in the space defined by the inner rim 9. Under this condition, the lid 15 is closed. At the closed position of the lid 15, the locking lugs 13 of lid 15 are engaged in the locking notches 12 provided at the inner rim 9, so that the lid 15 can be locked at its closed position. One of the reserve batteries 22 is seated on the bottom of extension 14 at the closed position of lid 15 while the other battery is supported by the reinforcing members 16 such that it is partially received in the battery supporting grooves 17.

As apparent from the above description, the present invention provides a holder for an emergency flashlight having a construction capable of holding reserve batteries and a reserve miniature bulb. By virtue of such a construction, it is possible to safely keep reserve batteries and a reserve miniature bulb at a place nearest to an emergency light. This enables an easy replacement of batteries and bulb in any situations and, thus, achieves an improvement in value of emergency light.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A holder for an emergency flashlight comprising:

an emergency flashlight;

a holder body having a pair of end members respectively with flashlight holding grooves for holding said emergency flashlight therein;

a flashlight grip opening defined between said end members;

a battery spacer protruded from said holder body in said flashlight grip opening;

an extension extending from a selected one of said end members;

an inner rim provided on said extension, said inner rim having opposite ends with a pair of hinges respectively protruded from opposite sides of one rim end thereof and a pair of locking notches respectively formed at said other rim end thereof;

a bulb holding member protruded from an inner surface of said extension;

a lid hingeably coupled to said extension allowing movement between an opened position and a closed position, said lid having a pair of hinge holes respectively engaged with said hinges and a pair of locking lugs respectively protruded from inner surfaces of opposite side walls of said lid and engaged in said locking notches at said closed position of the lid; and at least one reinforcing member protruded from an inner upper surface of said lid, said reinforcing member having a battery supporting groove.

2. In a holder for an emergency flashlight and having a holder body with a pair of end members including spaced apart grooves for holding said emergency flashlight therein, a flashlight grip opening defined between said end members, and a battery spacer protruded from said holder body in a spaced opening to grasp said flashlight, the improvement which comprises:

an extension projecting from one of said end members;

a U-shaped inner rim carried on said extension, said inner rim having a pair of hinges protruding in opposing relationship from opposite inner surfaces at one end of said inner rim and a pair of locking notches respectively formed at the opposite other end of said inner rim from said end carrying said hinges;

a bulb holding member protruded from an inner surface of said extension in spaced relationship with respect to said inner rim;

a hinged lid coupled to said extension such that said lid moves between an opened position and a closed position, said lid having a sidewall with a pair of hinge holes respectively engaged with said hinges and a pair of locking lugs projecting from said sidewall of said lid and engaged in said locking notches in said closed position of said lid; and at least one reinforcing member protruded from an inner upper surface of said lid, said reinforcing member having a battery supporting groove.

* * * * *